US007494929B2

(12) United States Patent
Swedek et al.

(10) Patent No.: US 7,494,929 B2
(45) Date of Patent: Feb. 24, 2009

(54) AUTOMATIC GAIN CONTROL

(75) Inventors: Boguslaw A. Swedek, Cupertino, CA (US); Doyle E. Bennett, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/413,495

(22) Filed: Apr. 27, 2006

(65) Prior Publication Data

US 2007/0251922 A1 Nov. 1, 2007

(51) Int. Cl.
*H01L 21/302* (2006.01)

(52) U.S. Cl. ..... 438/692; 438/693; 438/694; 438/17

(58) Field of Classification Search ..... 438/692, 438/693, 694, 16, 17, 691
See application file for complete search history.

(56) References Cited

U.S. PATENT DOCUMENTS 6,511,363 B2 1/2003 Yamane et al.
2004/0011462 A1 * 1/2004 Gotkis et al. ..... 156/345.13
2005/0194971 A1 * 9/2005 Lehman et al. ..... 324/230

* cited by examiner

*Primary Examiner*—Lan Vinh
(74) *Attorney, Agent, or Firm*—Fish & Richardson

(57) ABSTRACT

Methods and apparatus for automatic gain control. A film on a substrate is polished by a chemical mechanical polisher that includes a polishing pad and an in-situ monitoring system. The polishing pad includes a first portion, and the in-situ monitoring system includes a light source and a light detector. The light source emits light, and light emitted from the light source is directed through the first portion and to a surface of the film being polished. Light reflecting from the surface of the film being polished and passing through the first portion is received at the light detector. An electronic signal is generated based on the light received at the light detector. When the electronic signal is evaluated not to satisfy one or more constraints, a gain for the light detector is adjusted so that the electronic signal would satisfy the one or more constraints.

22 Claims, 4 Drawing Sheets

AUTOMATIC GAIN CONTROL

BACKGROUND

The present invention relates generally to chemical mechanical polishing of substrates.

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a moving polishing disk pad or belt pad. The polishing pad can be either a standard pad or a fixed abrasive pad. A standard pad has a durable roughened surface, whereas a fixed-abrasive pad has abrasive particles held in a containment media. The carrier head provides a controllable load on the substrate to push it against the polishing pad. A polishing slurry is typically supplied to the surface of the polishing pad. The polishing slurry includes at least one chemically reactive agent and, if used with a standard polishing pad, abrasive particles.

One problem in CMP is determining whether the polishing process is complete, i.e., whether a substrate layer has been planarized to a desired flatness or thickness, or when a desired amount of material has been removed. Overpolishing (removing too much) of a conductive layer or film leads to increased circuit resistance. On the other hand, underpolishing (removing too little) of a conductive layer leads to electrical shorting. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint, and the polishing endpoint, hence, cannot be determined merely as a function of polishing time. Consequently, endpoint determination is usually made in consideration of one or more in-situ measurements of a property of the substrate layer being polished. Such measurements are typically taken by an in-situ monitoring system, which can implement optical and/or eddy current measurement techniques, depending on the type of sensors included in the system. The accuracy of an endpoint determination usually depends at least in part on the proper operation of sensors of the in-situ monitoring system.

SUMMARY

In general, in one aspect, the invention provides a method and a computer program product implementing the method. The method includes commencing a polishing step in which a film on a substrate is polished by a chemical mechanical polisher that includes a polishing pad and an in-situ monitoring system. The polishing pad includes a first portion, and the in-situ monitoring system includes a light source and a light detector. Polishing is effected by causing the film to be in contact with the polishing pad while there is relative motion between the film and the polishing pad. During the polishing step, the light source emits light, and light emitted from the light source is directed through the first portion and to a surface of the film being polished. Light reflecting from the surface of the film being polished and passing through the first portion is received at the light detector. A first electronic signal is generated based on the light received at the light detector. The method evaluates, during the polishing step, whether the first electronic signal satisfies one or more constraints. When the first electronic signal is evaluated not to satisfy the one or more constraints, a gain for the light detector is adjusted so that the first electronic signal would satisfy the one or more constraints.

Particular implementations can include one or more of the following features. The gain is set before the first electronic signal is generated. When the first electronic signal is generated, the first portion has a current thickness that is different from a thickness that the first portion had when the gain was set. A change in thickness of the first portion changes a property exhibited by the first electronic signal, and the adjusting compensates for a change in thickness of the first portion that occurs from when the gain is set and when the first electronic signal is generated.

The one or more constraints include a constraint requiring the property be within a first target range. The gain is set before the polishing step commences, and the gain is set using a hardware gain control and an offset control and in a coarse calibration process that uses a second target range that is greater than the first target range. The gain is set after the polishing step commences and by a previous adjusting of the gain. The property exhibited by the first electronic signal is one of amplitude and phase difference. Generating the first electronic signal includes receiving a raw electronic signal from the light detector, where the raw electronic signal is proportional to a property of the light received at the light detector, and the gain is applied to the raw electronic signal.

The in-situ monitoring system is a first in-situ monitoring system, and the polishing pad is a first polishing pad. The chemical mechanical polisher includes a second in-situ monitoring system and a second polishing pad that includes a window through which light of the second in-situ monitoring system passes. The first electronic signal exhibits a property, and the one or more constraints include a requirement that the property exhibited by the first electronic signal be within a target range set for light detectors of the first in-situ monitoring system and of the second in-situ monitoring system.

The in-situ monitoring system includes an eddy current sensor. A second electronic signal is generated from the eddy current sensor, and the method evaluates whether the second electronic signal satisfies the one or more constraints. When the second electronic signal is evaluated not to satisfy the one or more constraints, a gain for the eddy current sensor is adjusted so that the second electronic signal would satisfy the one or more constraints. The one or more constraints include a requirement that each of an amplitude of the first electronic signal and an amplitude of the second electronic signal be within a same target range set for the light detector and for the eddy current sensor. The polishing pad has a first side that includes a polishing surface and a second side that is opposite to the first side. The eddy current sensor is situated adjacent to the first portion of the polishing pad and on the second side of the polishing pad.

The method evaluates whether the first electronic signal satisfies the one or more constraints include waiting for a duration of time before commencing the evaluation so that an unstable portion of the first electronic signal is not considered. During the polishing step, the method re-evaluates whether the first electronic signal satisfies the one or more constraints. When the first electronic signal is re-evaluated not to satisfy the one or more constraints, the gain for the light detector is adjusted so that the first electronic signal would satisfy the one or more constraints.

The first portion is a solid window or a thinned portion of the polishing pad. The film is a copper film. The first polishing step is included in one of copper chemical mechanical polishing (CMP), tungsten CMP, CMP for shallow trench isolation, CMP of inter-level dielectric, CMP of pre-metal dielectric, CMP of inter-metal dielectric, and CMP of polysilicon.

In another aspect, the invention provides a chemical mechanical polisher that includes a polishing pad that includes a first portion. The chemical mechanical polisher also includes a light source, a light detector, and a controller operable to perform a calibration method. The calibration method includes commencing a polishing step in which a film on a substrate is polished by the polisher, polishing being effected by causing the film to come into contact with the polishing pad while there is relative motion between the film and the polishing pad. During the polishing step, the light source emits light and light emitted from the light source is directed through the first portion and to a surface of the film being polished. Light reflecting from the surface of the film being polished is received at the light detector and is passed through the first portion. A first electronic signal is generated based on the light received at the light detector. During the polishing step, the method evaluates whether the first electronic signal satisfies one or more constraints. When the first electronic signal is evaluated not to satisfy the one or more constraints, a gain for the light detector is adjusted so that the first electronic signal would satisfy the one or more constraints.

As used in the instant specification, the term substrate can include, for example, a product substrate (e.g., which includes multiple memory or processor dies), a test substrate, a bare substrate, and a gating substrate. The substrate can be at various stages of integrated circuit fabrication, for example, the substrate can include one or more deposited and/or patterned layers. The term substrate can include circular disks and rectangular sheets.

Possible advantages of implementations of the invention can include one or more of the following. One implementation of the invention can provide an automatic calibration process in which sensors of an in-situ monitoring system are matched. When sensors are matched, the signals from the sensors are normalized and thus can be meaningfully compared to each other. Signals from sensors being match can be adjusted, for example, so that their amplitude is within a same target range. When sensors are matched, a same endpoint determination process, e.g., a same set of computer-executable instructions, can be used for an in-situ monitoring system that includes different types of sensors and/or for different chemical mechanical polishers.

The automated calibration does not require labor-intensive and manual adjustments of sensor electronic hardware, which are typically difficult and time consuming to effect. In one implementation, calibration is effected in two stages, a first stage that provides coarse calibration and a second stage that provides fine calibration. The coarse calibration is performed by manual adjustment of hardware-implemented gain and offset controls. The fine calibration is performed by automatic adjustment of software-implemented control or controls. Each time a polishing pad of a polisher is replaced, the fine calibration but not necessarily the coarse calibration can be effected for proper operation of the sensors. Thus, human operators need not manually perform calibration when replacing a polishing pad. Rather, the operator usually need only to replace the pad and initiate polishing.

The automated calibration process can be implemented as part of a polishing step so that sensors are automatically adjusted (e.g., to normalize their signals) each time the polishing step is performed. There can be multiple automatic adjustments during polishing. Automatic adjustment, as the terms are used in the present specification, refers to an adjustment that can be effected without requiring input from a human operator, at the time of the adjustment, other than initiating polishing.

The automated calibration process can compensate for changes in pad conditions that can affect an electronic signal of the in-situ monitoring system. For example, the process can compensate for a change of a property of an electronic signal from a sensor caused by a change in the thickness of a window in the polishing pad, even if the change occurred during a single polishing step, because the process can be implemented to make multiple adjustments during the polishing step.

The automated calibration process can compensate for variations in polishing pad window characteristics, for example, window thickness and light transmissivity. These variations can be caused by manufacturing processes that are not perfectly consistent. The automated calibration process described can facilitate calibration each time a pad is replaced in a polisher and, hence, a human operator need not performed a full and complete calibration each time the pad is replaced. As will be described below, the human operator need only performed a coarse calibration.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
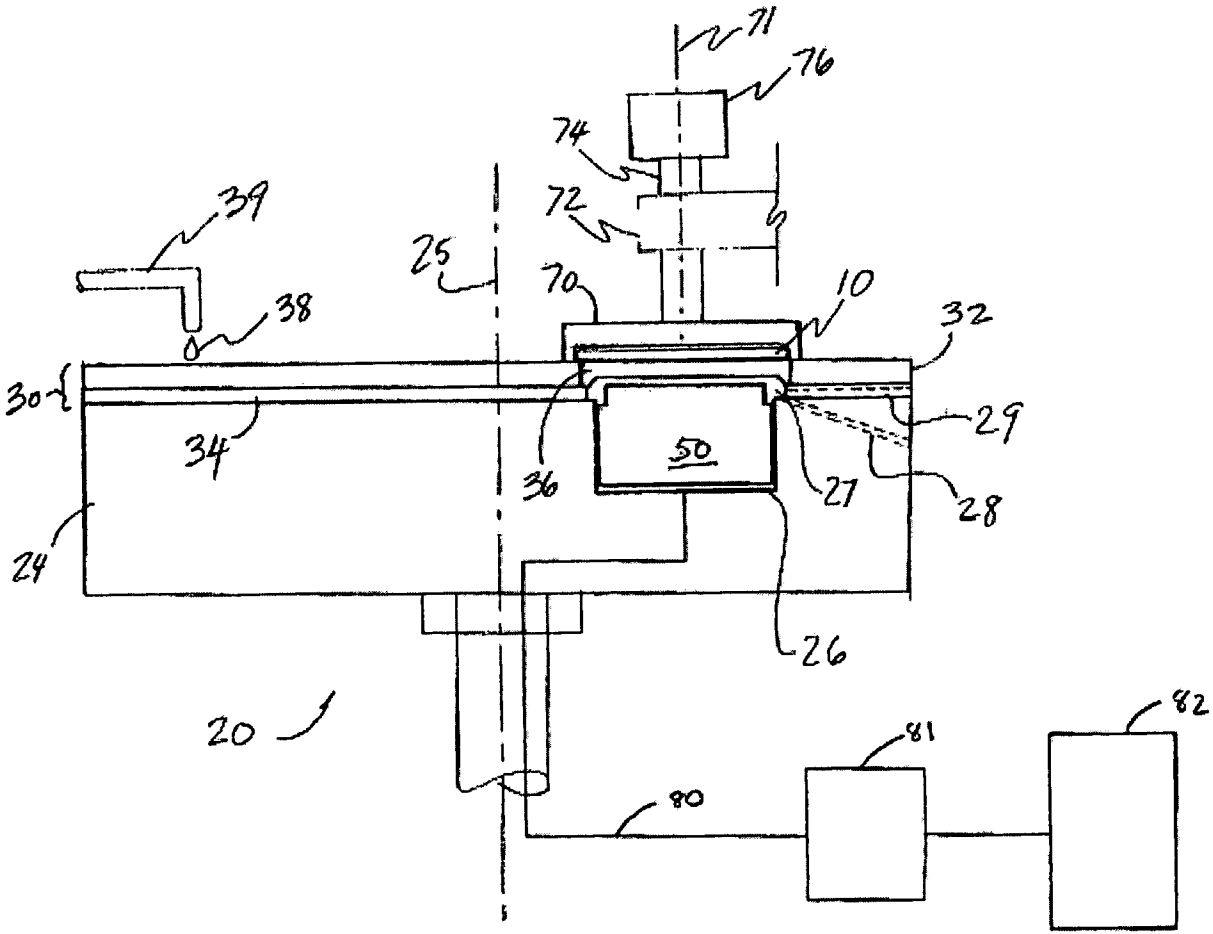
FIG. 1 is a schematic side view, partially cross-sectional, of a chemical mechanical polishing station suitable for calibration in accordance with the invention.

As shown in FIG. 1, a substrate 10 can be polished by a CMP apparatus 20. A description of a suitable polishing apparatus 20 can be found in U.S. Pat. No. 5,738,574, the entire disclosure of which is incorporated herein by reference.

The polishing apparatus 20 includes a rotatable disk-shaped platen 24, on which is placed a polishing pad 30. The polishing pad 30 can be secured to the platen 24, for example, by a layer of adhesive.

A recess 26 is formed in platen 24, and an in-situ monitoring module 50 of an in situ monitoring system is typically situated in the recess 26. The in-situ monitoring module 50 is connected to communicate, through communication medium 80, with a computing system, for example, one that includes a controller 81 and a computer 82. The in-situ monitoring system can include one or more eddy current sensors, one or more light detectors, one or more light sources, one or more other types of sensors, or a combination of the mentioned sensors. Sensors usually provide better resolution when they are situated close to the substrate being polished. Examples of an eddy current sensor include but are not limited to a U-shaped ferromagnetic core and an E-shaped ferromagnetic core. Examples of a light source include but are not limited to a light source that emits a laser beam, a light source that emits monochromatic light, and a light source that emits white light. Examples of a light detector include but are not limited to a spectrophotometer and a photodiode. A suitable in-situ module is further described in commonly-owned U.S. Pat. No. 7,001,242 and U.S. patent application Ser. Nos. 10/123,917, filed on Apr. 16, 2002, and Ser. No. 10/633,276, filed Jul. 31, 2003, which are hereby incorporated by reference in their entireties.

The polishing pad 30 can be a multiple-layer polishing pad, for example, a two-layer polishing pad with an outer polishing layer 32 and a softer backing layer 34. The polishing station can also include a pad conditioner apparatus to maintain the condition of the polishing pad so that it will effectively polish substrates.

The polishing pad can include a region 36 that is thinner than other portions of the polishing pad. In particular, the region 36 can be a portion of the polishing pad which is thinner than the polishing layer, e.g., less than 50% of the thickness of the polishing layer. The region can be either transparent or opaque, as will be described below. The region 36 can be an integral portion of the polishing pad 30, or it can be an element secured, e.g., molded or adhesively attached, to the polishing pad 30. The element can be sealed to the polishing pad 30 so that liquid does not leak through an interface of the element and the polishing pad 30. The element can have a top surface that lies flush with the top surface of the polishing pad 30. The element can be a solid window that is transparent to the light emitted by one or more light sources included in the in-situ monitoring module 50. Transparency allows transmission of light to the substrate 10 to effect measurements of one or more properties of the substrate. Suitable windows are described in commonly assigned U.S. patent application Ser. No. 11/213,675, filed on Aug. 26, 2005, which is hereby incorporated by reference.

The region 36 can include a recess, which can be formed in the bottom surface of the polishing pad 30 (in the case where the region is an integral part of the polishing pad) or a bottom surface of the element secured in the polishing pad 30 (in the case where the region is an element secured to the polishing pad). The recess extends partially but not entirely through the polishing layer, so that a thin section of the polishing layer or element remains. The recess allows an end of a sensor assembly or a sensor, e.g., an optical fiber cable connected to convey light to and from a light detector and a light source, respectively, or an end of an eddy current sensor, to be situated at a distance from the substrate being polished that is less than the thickness of the polishing pad.

The region 36 is situated over at least a portion of the recess 26 and the module 50. The module 50 and region 36 are positioned such that they pass beneath substrate 10 during a portion of the platen's rotation.

The polishing apparatus 20 includes a carrier head 70 operable to hold the substrate 10 against the polishing pad 30. The carrier head 70 is suspended from a support structure 72, for example, a carousel, and is connected by a carrier drive shaft 74 to a carrier head rotation motor 76 so that the carrier head can rotate about an axis 71. In addition, the carrier head 70 can oscillate laterally in a radial slot formed the support structure 72. In operation, the platen is rotated about its central axis 25, and the carrier head is rotated about its central axis 71 and translated laterally across the top surface of the polishing pad. A description of a suitable carrier head 70 can be found in U.S. Pat. Nos. 6,422,927 and 6,450,868, issued on Jul. 23, 2002 and Aug. 17, 2002, respectively, and U.S. patent application Ser. No. 10/810,784, filed Mar. 26, 2004, the entire disclosures of which are incorporated by reference.

During a polishing step, a slurry 38 containing a liquid and a pH adjuster can be supplied to the surface of polishing pad 30 by a slurry supply port or combined slurry/rinse arm 39. Slurry 38 can also include abrasive particles.

In implementations where the region 36 provides a barrier against slurry leakage between the recess 26 and the top surface of the polishing pad 20, for example, the above described implementations, the region 36, together with the top portion of the module 50 and the side walls of the platen 24, can form a cavity 27, which can trap fluid and/or be air tight. Venting of the cavity 27 can be effected by one or more vent paths, for example, vent path 28 and vent path 29.

As discussed above, the polishing apparatus 20 includes sensors of an in-situ monitoring system. The sensors are each connected to the computing system, which is operable to control their operation and to receive their signals. The computing system can optionally include a microprocessor, e.g., a controller 81 situated near the polishing apparatus, and a computer, e.g., desktop computer 82. With respect to control, the computing system can synchronize activation of one or more sensors with the rotation of the platen 24. For example, the computer system can actuate an eddy current sensor and/or cause a light source to emit a series of flashes starting just before and ending just after the substrate 10 passes over the in-situ monitoring module. Alternatively, the computer can cause the light source to emit light continuously starting just before and ending just after the substrate 10 passes over the in-situ monitoring module.

With respect to receiving signals, the computing system can receive, for example, a signal that carries information describing one or more properties of the light received by the light detector and/or information describing one or more properties of eddy current passing through a substrate layer of interest. The computing system can process the above-described signal to determine an endpoint of a polishing step. The computing system can execute logic that determines, based on one or more of the properties of the eddy current and/or the received light, when an endpoint has been reached. Moreover, the computing system can implement an automated calibration process, which can, for example, match sensors of the polishing apparatus. Matching sensors can include manipulating their signals so that the signal amplitudes fall within a common target range, as will be described below in reference to FIGS. 2 and 3.

Figure 2:
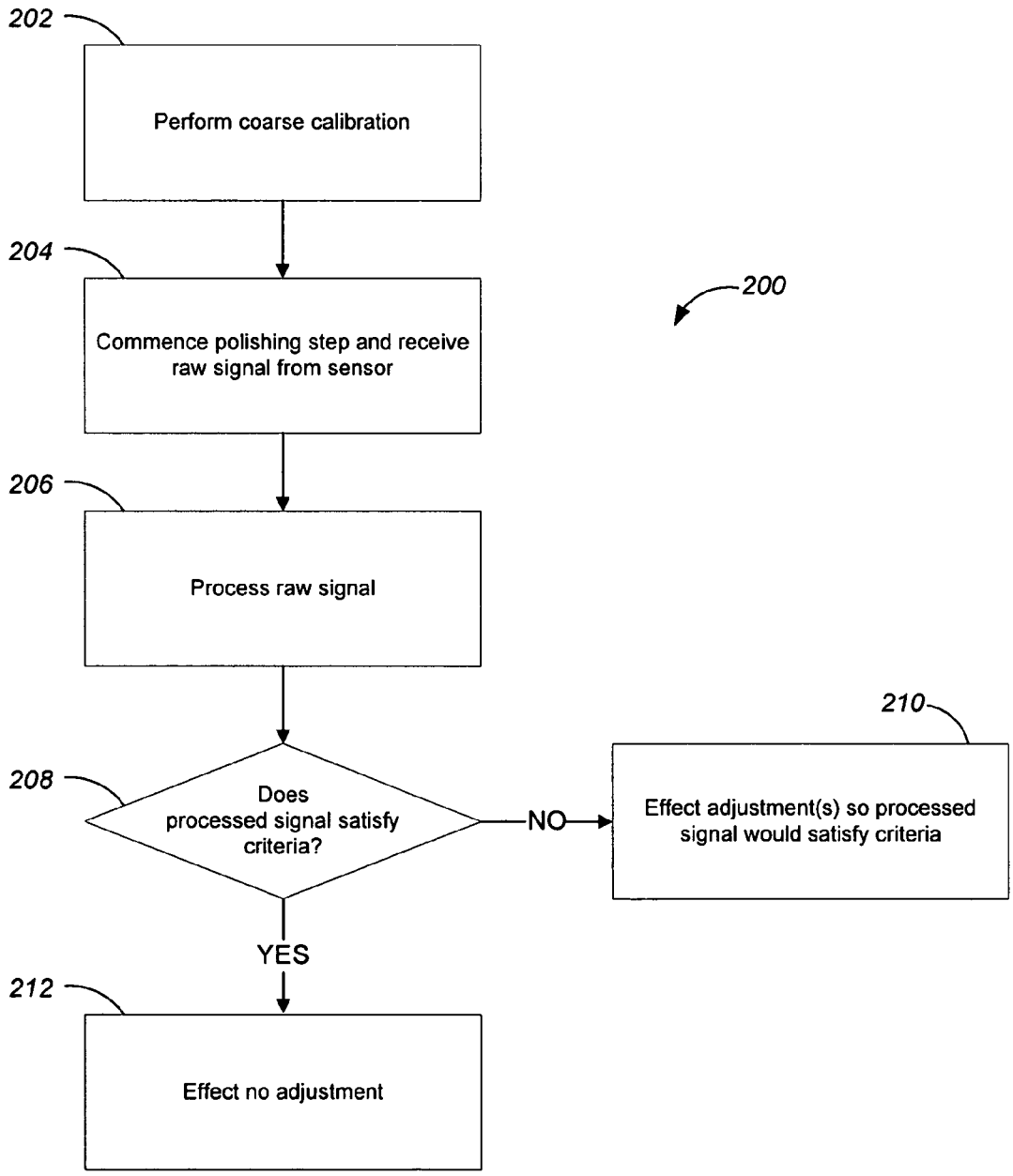
FIG. 2 shows a method for calibrating an in-situ monitoring system.

FIG. 2 shows a method 200 for automatically calibrating an optical sensor of an in-situ monitoring system. An optional coarse calibration is performed (step 202). In the coarse calibration, an offset control and a gain control are adjusted as necessary so that one or more properties of a processed signal of the sensor satisfies one or more criteria for coarse calibration. The properties can include, for example, an amplitude of the signal and an offset of the signal. The criteria for coarse calibration can include, for example, one or more target ranges and one or more coarse limits.

The offset control and the gain control can be implemented in hardware, and a human operator can perform the coarse calibration. Processing throughput and fine calibration efficacy should be considered in selecting values for the one or more criteria. By way of example, a coarse target range should be sufficiently large so that the coarse calibration can be effected without significantly slowing down throughput during production. On the other hand, the coarse target range should be sufficiently small so that subsequent automatic software-implemented adjustments of the gain can be made so that the property of the signal from the sensor is within a fine target range. With an implementation in which the signal property being considered is amplitude, for example, the coarse target range is plus or minus 20% of a target amplitude value.

At the time when the coarse calibration is effected, a region of the polishing pad through which light or eddy current is transmitted, i.e., a sensing region, has one or more characteristics that can affect optical sensor signals. The one or more characteristics can include, for example, thickness as well as other characteristics that are a function of thickness such as light transmissivity, opacity, and reflectivity. When the region includes a solid window as described above, for example, the window can be of a particular thickness.

When a polishing step is commenced, a raw signal from the optical sensor is received (step 204). The raw signal is usually proportional to the intensity of light reflecting from the substrate surface being polished. The raw signal can be and is typically affected by a change in the one or more characteristics of the sensing region.

The time when the polishing step is commenced can be different than the time when the coarse calibration was effected. The one or more characteristics of the sensing region may have changed in the intervening time, and the change can be sufficient to cause a change in one or more properties of a signal of the optical sensor. For example, the thickness of the window in the polishing pad can change so that transmissivity is increased. As a result, an amplitude of a sensor signal that is proportional to the intensity of light received by the sensor would increase. Alternatively, slurry being used in the polishing step can decrease transmissivity so that the amplitude of the sensor signal would decrease.

The polishing step can be one that is included, for example, in chemical mechanical polishing of copper or tungsten, chemical mechanical polishing for shallow trench isolation, chemical mechanical polishing of interlevel-dielectric (either pre-metal dielectric or inter-metal dielectric), or chemical mechanical polishing of polysilicon. The polishing step can be effected at a platen of the above-described polishing apparatus 20. The polishing step can be controlled by the above-described computing system.

The raw signal is processed (step 206). Processing can include, for example, amplification and offsetting in accordance with the gain and offset controls, which were set as a result of the coarse calibration. Processing can be effected by hardware and/or software.

The processed signal is evaluated to determine whether the signal satisfies criteria for fine calibration (step 208). The one or more criteria for fine calibration can be the same or similar to those for coarse calibration, except that target ranges and/or limits for fine calibration are usually more restrictive than those for coarse calibration. A target range for fine calibration can be included in a target range for coarse calibration. An example of a fine target range is plus or minus 5% of a target value.

Without being limited to any particular theory, it is observed that the processed signal can be unstable for a brief interval of time after polishing is commenced. Optionally, a portion of the signal that includes the unstable portion is not considered for the evaluation of step 208. An interval of time corresponding to the portion of the signal not considered can be empirically determined, and information specifying the interval can be stored in memory that is accessible to the computer executing instructions for effecting method 200. The information can be changed as appropriate, for example, when the instability of the signal is observed to last longer or shorter than the interval.

The evaluation of step 208 can be performed automatically as an integral part of the polishing step. Fine calibration, hence, can be effected each time the polishing step is performed. Computer executable instructions for fine calibration can be incorporated into instructions for effecting the polishing step. For example, instructions for effecting the polishing step can include multiple modules, one of which can be a module that includes instructions for the above-described fine calibration.

If the processed signal is evaluated to not satisfy the one or more criteria for fine calibration, one or more adjustments are automatically effected so that the processed signal would satisfy the one or more criteria for fine calibration (step 210). The adjustment is effected by using software-implemented controls. A gain applied to the signal and an offset of the signal, for example, can be adjusted by the software-implemented controls.

If, however, the processed signal is evaluated to satisfy the one or more criteria for fine calibration, adjustments to the signal are usually not necessary and none are made (step 212).

Optionally, steps 208 and 210 can be repeated periodically during the polishing step. The period can be, for example, 3-5 seconds.

Note that the above calibration method can compensate not only for any changes in window characteristics, but also for variances of window characteristics from pad to pad. A first polishing pad, for example, may include window having a first coefficient of transmissivity for light, and a second window, which replaced the first window in a polisher, may include a window having a second coefficient of transmissivity for light. A sensor signal generated while polishing with the first polishing pad can have, for example, a first amplitude, while a sensor signal generated while polishing with the second polishing pad can have a second amplitude that is different than the first amplitude. In this case, the described calibration method will normalized the two amplitudes so that they fall within a same range.

Figure 3:
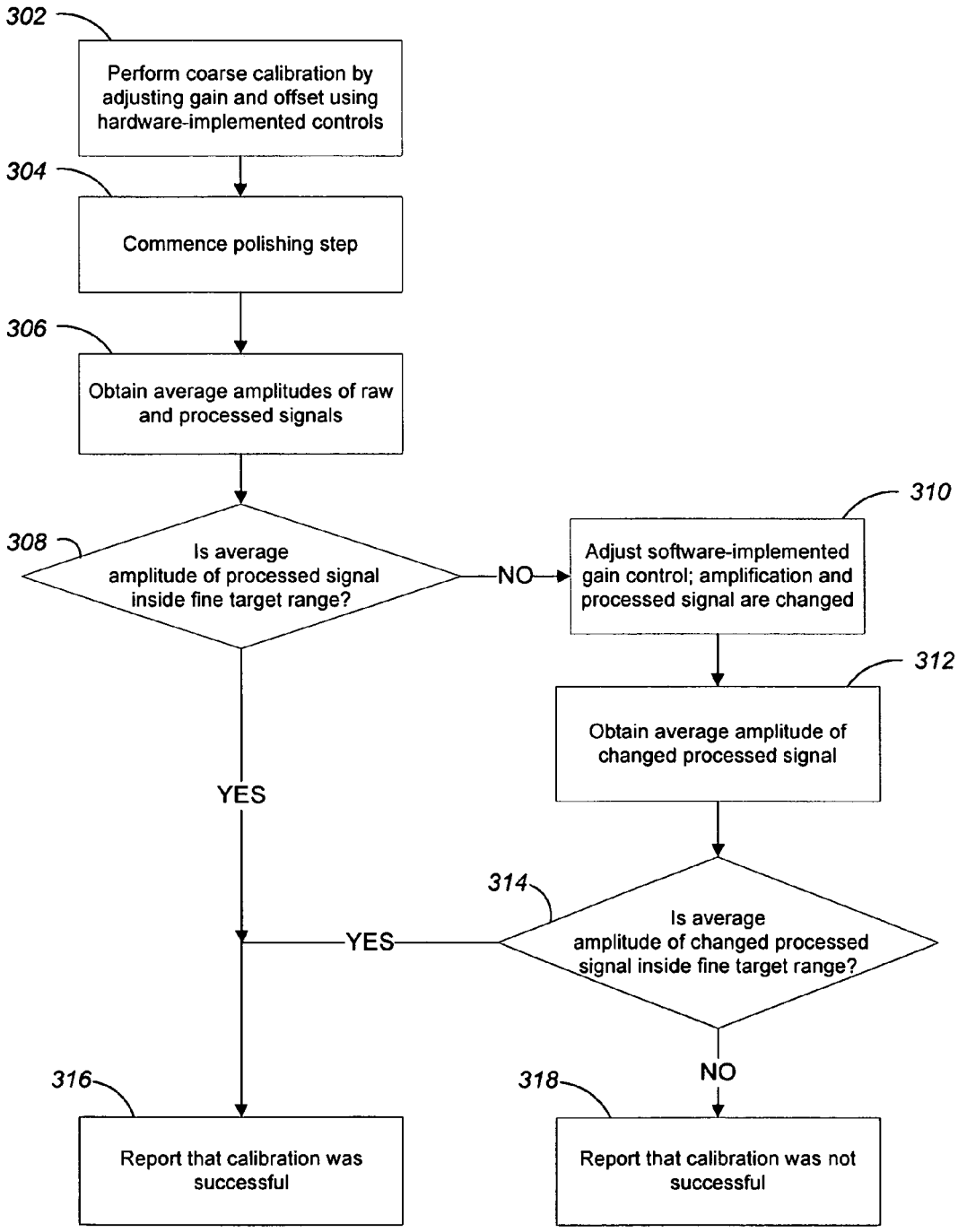
FIG. 3 shows an implementation of the method for calibrating an in-situ monitoring system.

FIG. 3 shows an implementation of the method 200. In the implementation, calibration is used for sensor matching. In particular, a light detector, used for chemical mechanical polishing of a copper film, is calibrated so that its signal is normalized with signals from other sensors (either optical or eddy current). Sensors that are calibrated in accordance with the instant implementation of method 200, including the light detector, would accordingly generate signals having amplitudes that are within a same target range of signal amplitude, as will be further described below. The light detector is part of an in-situ monitoring system and, furthermore, is configured to receive a laser beam reflecting from the copper film and, in response, generate an electronic signal that is proportional to an intensity of the received beam.

Hardware-implemented gain and offset controls for the light detector are adjusted so that an amplitude of an electronic signal generated from the light detector falls within a coarse target range (step 302). A reference copper wafer, i.e., one having a copper layer of known thickness, is placed within working range of the light detector. The in-situ monitoring system is actuated so that a laser beam is reflected off the copper layer and received by the light detector. In response, the light detector generates a signal, which is then processed and displayed. The controls are adjusted, usually by a human operator, so that the amplitude of the processed signal is within the coarse target range.

The same coarse target range of signal amplitude was or will be used to calibrate the other sensors with which the light detector is to be matched. Likewise, the same reference copper wafer is used for calibration of the other sensors.

A chemical mechanical polishing step is commenced (step 304). A product wafer that includes a copper layer is polished. The polishing is effected at a platen of the above-described polishing apparatus 20. The polishing step is controlled by the above-described computer system. During polishing, the in-situ monitoring system operates as described above so that the light detector receives a laser beam that was reflected from the copper layer and, in response, generates a raw electronic signal that is indicative of whether the copper layer is present. The raw signal is then processed, including being amplified and offset in accordance with the above-described hardware gain and offset controls. In addition to the hardware gain control, the signal is amplified also in accordance with software gain control, which can be adjusted as described below.

After waiting for a particular interval of time after the polishing step is commenced, an average amplitude of the raw signal and an average amplitude of the processed signal are automatically obtained (step 306). The particular interval of time includes the duration required for signals of the light detector to stabilize, and signals are not sampled during the particular interval of time to enhance sample accuracy. The respective signals are sampled in accordance with pre-defined criteria, which can specify, for example, the number of samples to be obtained and when the samples are obtained. The samples are then averaged to obtain the average amplitude of the raw signal and the average amplitude of the processed signal. The criteria are configurable and can be changed, for example, in response to user input. The criteria are stored in memory accessible to the computer system.

A determination is automatically made as to whether the average amplitude of the processed signal is inside a fine target range for signal amplitude (step 308). The fine target range for signal amplitude is defined by a target high amplitude and a target low amplitude. A signal is determined to be inside the fine target range if its amplitude is less than the target high value and greater than the target low amplitude. The target high amplitude and the target low amplitude are stored in memory that is accessible to the computer system. The same fine target range of signal amplitude was or will be used to calibrate the other sensors with which the light detector is to be matched.

If the average amplitude of the processed signal is determined to be inside of the fine target range, then calibration was successful and a report that so indicates is provided (step 316).

If, however, the average amplitude of the processed signal is determined to be not inside of the fine target range, then the software-implemented gain control is adjusted and, as a result, amplification of the raw signal is changed (step 310). Adjustment of the software-implemented gain control is effected by recalculating a gain value used to specify how much a signal is to be amplified. The recalculation is performed using the formula:

$$G=TSA/AARS$$

where G is the recalculated gain, TSA is a target signal amplitude, and AARS is the average amplitude of the raw signal (which was calculated in step 306). The same TSA was or will be used to calibrate the other sensors with which the light detector is to be matched.

In response to the change in amplification, the processed signal changes. Specifically, the amplitude of the signal changes in accordance with the change in amplification.

An average amplitude of the changed processed signal is obtained (step 312). The average is obtained as described in step 306.

A determination is made as to whether the averaged amplitude of the changed processed signal is inside the fine target range (step 314). If the averaged amplitude of the changed processed signal is inside the fine target range, then calibration is successful, and a report of the success is provided (step 316). Otherwise, calibration is unsuccessful, and a report indicating that calibration was not successful is provided (step 318).

Note that steps 304-318 are automatically performed by the computer system as part of the polishing step. Thus, calibration using the fine target range is effected for each instance the polishing step is performed.

Figure 4A:
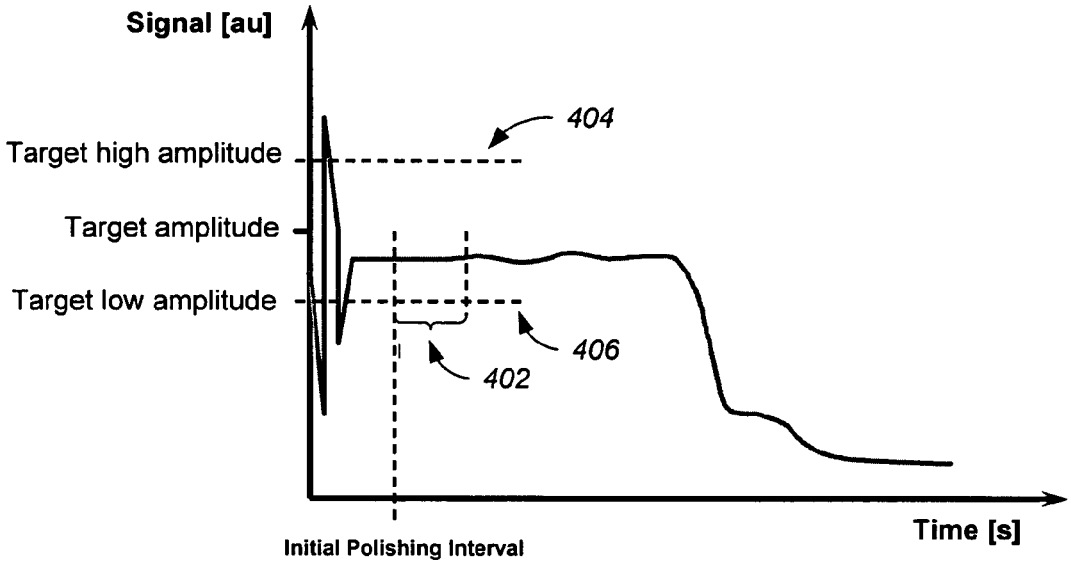
FIGS. 4*a* and 4*b* illustrate examples of automatic gain adjustment.
Figure 4B:
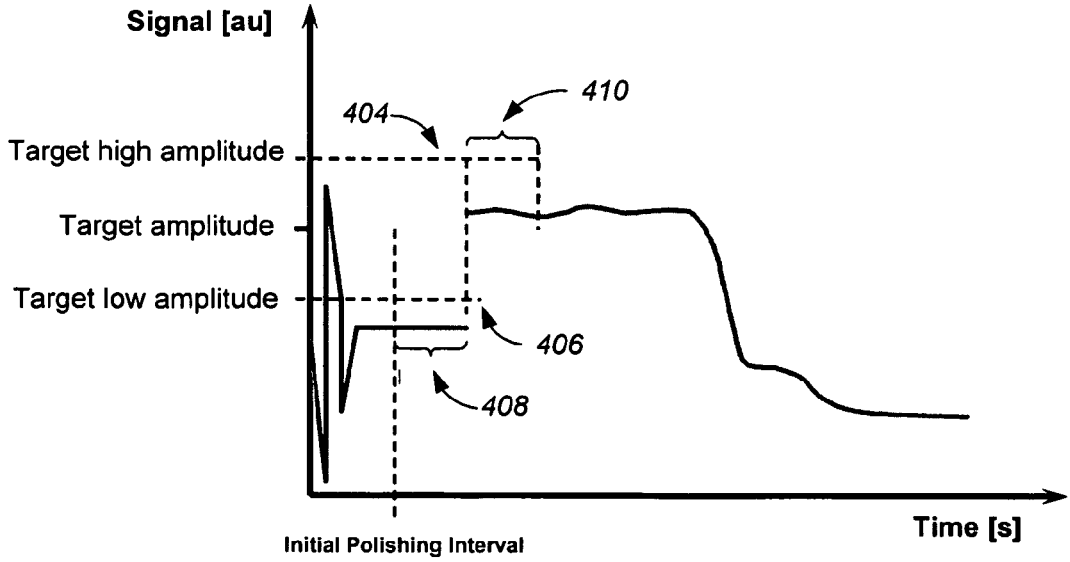

FIGS. 4*a* and 4*b* illustrate examples of the fine calibration method described in FIG. 3. In the example shown in FIG. 4*a*, the average amplitude 402 of the processed signal is inside the fine target range, defined by the target high amplitude 404 and the target low amplitude 406. Hence, an adjustment of software-implemented gain control is not necessary, and the polishing step continues until an endpoint is detected. In the example shown in FIG. 4*b*, the average amplitude 408 of the processed signal is less than the target low amplitude 406 and, hence, is not inside of the fine target range. The software-implemented gain control is automatically adjusted as described above in step 310. The adjustment is effect at about 3-10 seconds after polishing commences. The average amplitude 410 of the processed signal that has been changed is inside the fine target range so the adjustment was successful. The polishing step continues until the endpoint is detected.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in an information carrier, e.g., in a machine-readable storage device or in a propagated signal, for execution by, or to control the operation of, data processing apparatus, e.g., a programmable processor, a computer, or multiple processors or computers. A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the invention can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

A number of embodiments of the invention have been described. Nevertheless, it will be understood that various modifications may be made without departing from the spirit and scope of the invention. For example, method steps can be performed in an order that is different than that described above and still provide benefits of the invention. The described target ranges need not be defined by an upper and lower limit but rather can be define otherwise. The fine target range can be defined by a target amplitude and one or more percentages, for example, +15% and −20%. Accordingly, other embodiments are within the scope of the following claims.

What is claimed is:

1. A computer implemented method for calibrating, comprising:

commencing a polishing step in which a film on a substrate is polished by a chemical mechanical polisher that includes a polishing pad and an in-situ monitoring system, polishing being effected by causing the film to be in contact with the polishing pad while there is relative motion between the film and the polishing pad;

during the polishing step, causing the in-situ monitoring system to monitor the film being polished through a first portion of the polishing pad;

during the polishing step, generating a first electronic signal from a detector in the in-situ monitoring system with a gain for the in-situ monitoring system set to a first value, the detector sensitive to a characteristic of the film being polished; and during the polishing step, evaluating whether the first electronic signal satisfies one or more constraints and, when the first electronic signal is evaluated not to satisfy the one or more constraints, adjusting the gain for the in-situ monitoring system to a second value different from the first value so that the first electronic signal would satisfy the one or more constraints; wherein the gain was set to the first value before the first electronic signal was generated;

when the first electronic signal was generated, the first portion has a current thickness that is different from a thickness that the first portion had when the gain was set;

a change in thickness of the first portion of the polishing pad changes a property exhibited by the first electronic signal; and the adjusting compensates for a change in thickness of the first portion that occurred from when the gain was set to the first value and when the first electronic signal was generated.

2. The method of claim 1, wherein:

the one or more constraints include a constraint requiring the property be within a first target range;

the gain was set to the first value before the polishing step was commenced; and the gain was set to the first value using a hardware gain control and an offset control and in a coarse calibration process that uses a second target range that is wider than the first target range.

3. The method of claim 1, wherein:

the gain was set to the first value after the polishing step was commenced and by a previous adjusting of the gain.

4. The method of claim 1, wherein:

the property exhibited by the first electronic signal is amplitude.

5. The method of claim 1, wherein generating the first electronic signal includes:

receiving a raw electronic signal from the detector; and applying the gain to the raw electronic signal.

6. The method of claim 1, wherein:

the first portion is a solid window or a thinned portion of the polishing pad.

7. The method of claim 1, wherein the in-situ monitoring system includes an eddy current sensor.

8. The method of claim 7, wherein the first portion is a thinned portion of the polishing pad.

9. A computer-implemented method for calibrating, the method comprising:

commencing a polishing step in which a film on a substrate is polished by a chemical mechanical polisher that includes a polishing pad and an in-situ monitoring system, polishing being effected by causing the film to be in contact with the polishing pad while there is relative motion between the film and the polishing pad;

during the polishing step, causing the in-situ monitoring system to monitor the film being polished through a first portion of the polishing pad;

during the polishing step, generating a first electronic signal from a detector in the in-situ monitoring system with a gain for the in-situ monitoring system set to a first value, the detector sensitive to a characteristic of the film being polished; and during the polishing step, evaluating whether the first electronic signal satisfies one or more constraints and, when the first electronic signal is evaluated not to satisfy the one or more constraints, adjusting the gain for the in-situ monitoring system to a second value different from the first value so that the first electronic signal would satisfy the one or more constraints;

wherein:

the in-situ monitoring system is a first in-situ monitoring system, and the polishing pad is a first polishing pad, the chemical mechanical polisher including a second in-situ monitoring system and a second polishing pad;

the first electronic signal exhibits a property; and the one or more constraints include a requirement that the property exhibited by the first electronic signal be within a target range set for detectors of the first in-situ monitoring system and of the second in-situ monitoring system.

10. A computer implemented method for calibrating, comprising:

commencing a polishing step in which a film on a substrate is polished by a chemical mechanical polisher that includes a polishing pad and an in-situ monitoring system, polishing being effected by causing the film to be in contact with the polishing pad while there is relative motion between the film and the polishing pad;

during the polishing step, causing the in-situ monitoring system to monitor the film being polished through a first portion of the polishing pad;

during the polishing step, generating a first electronic signal from a detector in the in-situ monitoring system with a gain for the in-situ monitoring system set to a first value, the detector sensitive to a characteristic of the film being polished;

during the polishing step, evaluating whether the first electronic signal satisfies one or more constraints and, when the first electronic signal is evaluated not to satisfy the one or more constraints, adjusting the gain for the in-situ monitoring system to a second value different from the first value so that the first electronic signal would satisfy the one or more constraints, wherein the in-situ monitoring system includes a light source and a light detector and an eddy current sensor, and causing the in-situ monitoring system to monitor the film includes causing the light source to emit light and receiving, at the light detector, light reflecting from the film being polished, and wherein adjusting the gain for the in-situ monitoring system includes adjusting a gain of the light detector; generating a second electronic signal from the eddy current sensor with a gain for the eddy current sensor set to a first value; and evaluating whether the second electronic signal satisfies the one or more constraints and, when the second electronic signal is evaluated not to satisfy the one or more constraints, adjusting the gain for the eddy current sensor to a second value different than the first value so that the second electronic signal would satisfy the one or more constraints.

11. The method of claim 10, wherein:

the one or more constraints include a requirement that each of an amplitude of the first electronic signal and an amplitude of the second electronic signal be within a same target range set for the light detector and for the eddy current sensor.

12. The method of claim 10, wherein:

the polishing pad has a first side that includes a polishing surface and a second side that is opposite to the first side; and the eddy current sensor is situated adjacent to the first portion of the polishing pad and on the second side of the polishing pad.

13. A computer-implemented method for calibrating, the method comprising:

commencing a polishing step in which a film on a substrate is polished by a chemical mechanical polisher that includes a polishing pad and an in-situ monitoring system, polishing being effected by causing the film to be in contact with the polishing pad while there is relative motion between the film and the polishing pad;

during the polishing step, causing the in-situ monitoring system to monitor the film being polished through a first portion of the polishing pad;

during the polishing step, generating a first electronic signal from a detector in the in-situ monitoring system with a gain for the in-situ monitoring system set to a first value, the detector sensitive to a characteristic of the film being polished; and during the polishing step, evaluating whether the first electronic signal satisfies one or more constraints and, when the first electronic signal is evaluated not to satisfy the one or more constraints, adjusting the gain for the in-situ monitoring system to a second value different from the first value so that the first electronic signal would satisfy the one or more constraints:

wherein:

evaluating whether the first electronic signal satisfies the one or more constraints include waiting for a duration of time before commencing the evaluation so that an unstable portion of the first electronic signal is not considered.

14. The method of claim 13, wherein:

the film is a copper film.

15. The method of claim 13, wherein:

the first polishing step is included in one of copper chemical mechanical polishing (CMP), tungsten CMP, CMP for shallow trench isolation, CMP of inter-level dielectric, CMP of pre-metal dielectric, CMP of inter-metal dielectric, and CMP of polysilicon.

16. The method of claim 13, wherein the adjusting step is performed at most once during the polishing step.

17. The method of claim 13, wherein evaluating includes evaluating a portion of the first electronic signal representing the substrate.

18. The method of claim 13, wherein the polishing step includes rotating a platen to which the polishing pad is attached, the detector is supported by the platen, and evaluating includes evaluating a portion of the first electronic signal representing a scan of the detector across the substrate.

19. The method of claim 13, wherein the in-situ monitoring system includes a light source and a light detector, and causing the in-situ monitoring system to monitor the film includes causing the light source to emit light and receiving, at the light detector, light reflecting from the film being polished.

20. The method of claim 19, wherein adjusting the gain for the in-situ monitoring system includes adjusting a gain of the light detector.

21. The method of claim 19, wherein generating the first electronic signal includes:

receiving a raw electronic signal from the light detector, the raw electronic signal being proportional to a property of the light received at the light detector; and applying the gain to the raw electronic signal.

22. The method of claim 19, wherein the first portion is a solid window.

* * * * *

UNITED STATES PATENT AND TRADEMARK OFFICE

CERTIFICATE OF CORRECTION

PATENT NO. : 7,494,929 B2
APPLICATION NO. : 11/413495
DATED : February 24, 2009
INVENTOR(S) : Boguslaw A. Swedek It is certified that error appears in the above-identified patent and that said Letters Patent is hereby corrected as shown below:

Col. 14, claim 13, line 23, after "constraints" change ":" to --;--.

Signed and Sealed this

Fifteenth Day of September, 2009

David J. Kappos

David J. Kappos
*Director of the United States Patent and Trademark Office*